US005459907A

United States Patent [19]

Nivet

[11] Patent Number: 5,459,907

[45] Date of Patent: Oct. 24, 1995

[54] ANNULAR FASTENING DEVICE

[75] Inventor: André Nivet, Beauchamp, France

[73] Assignee: ITW de France, Beauchamp, France

[21] Appl. No.: 145,535

[22] Filed: Nov. 4, 1993

[30] Foreign Application Priority Data

Nov. 4, 1992 [FR] France ..... 92 13221

[51] Int. Cl.[6] ..... A44B 21/00

[52] U.S. Cl. ..... 24/484; 24/16 PB; 24/712

[58] Field of Search ..... 24/16 R, 16 PB, 24/30.5 P, 30.5 R, 17 AP, 484, 712; 292/318, 320, 321, 325; 248/74.3

[56] References Cited

U.S. PATENT DOCUMENTS

| | | | |
|---|---|---|---|
| 3,588,962 | 6/1971 | Feldberg | 24/16 PB |
| 3,965,538 | 6/1976 | Caveney et al. | 24/16 PB |
| 3,967,345 | 7/1976 | Sumimoto | 24/16 PB |
| 4,413,380 | 11/1983 | Suzuki | 24/16 PB |
| 4,507,828 | 4/1985 | Furutsu | 24/16 PB |
| 4,636,347 | 1/1987 | Kato . | |
| 5,055,066 | 10/1991 | Garretson | 24/16 PB X |

FOREIGN PATENT DOCUMENTS

| | | | |
|---|---|---|---|
| 2139091 | 3/1972 | Germany . | |
| 3619809 | 12/1987 | Germany | 24/16 R |
| 2145150 | 3/1985 | United Kingdom | 24/16 PB |

*Primary Examiner*—James R. Brittain
*Attorney, Agent, or Firm*—Schwartz & Weinrieb

[57] ABSTRACT

The annular fastening device comprises a male attachment element (2) of moulded plastic material, a female attachment element (3) of moulded plastic material, and a flexible strap (4) which is attached at a first end to the male attachment element (2) and at a second end to the female attachment element (3).

A seat cover includes a hem which is peripheral to an opening for introducing the cover onto a seat, together with a fastening device, the strap (4) of which is inserted through the said hem.

In accordance with a method of securing the cover to the seat, a cover is used, which is slid over the seat and which is stretched over the seat cushion of the seat by means of the annular fastening device (1).

20 Claims, 2 Drawing Sheets

ANNULAR FASTENING DEVICE

FIELD OF THE INVENTION

This invention relates in its most general form to annular fastening devices, that is to say to elements which are capable of adopting the shape of a closed loop, the dimensions of which can be reduced so as to achieve fastening with a gripping effect.

SUMMARY OF THE INVENTION

The present invention provides an annular fastening device which is long, thin and flexible while being capable, without any delicate maneuvering, of being closed on itself at the same time as its tension is adjusted, and which is also particularly reliable as regards its resistance to coming apart.

To this end, the invention proposes an annular fastening device, characterised in that it includes:

a male attachment means of moulded plastic material;

a female attachment means of moulded plastic material and including between an entry end and an exit end a passage for the said male attachment means, the said male and female attachment means being adapted to cooperate in such a way that the male attachment means can penetrate into the female attachment means by advancing through the said passage from the entry end, and in that, over at least a major portion of the length of the male attachment means, if it then tends to retract out from the female attachment means, it is retained at the position which it has reached; and a flexible strap, fixed at a first end to the said male attachment means, and at a second end to the said female attachment means.

The strap is a conventional strap, that is to say an assembly of linked fibres which are twisted together. This is what gives the annular gripping element its flexibility and slenderness, and it also enables the said element to be made without any difficulty to the desired length, even if it is particularly large, because it is only necessary to arrange the desired length of strap between the male attachment means and the female attachment means.

The presence of the male attachment means in a moulded plastic material enables the annular fastening element to be easily closed onto itself, since because of the material of which it is made, it has a rigidity which is greater than that of the strap, so that in consequence, the male attachment means is very much easier to insert into the female attachment means than the strap itself would be.

In addition, making the male attachment means by moulding enables the latter to be easily given such a shape that it is capable of cooperating with the female attachment means as described above, with a high degree of reliability as regards resistance to coming apart.

In one embodiment which is preferred for reasons of simplicity, convenience and economy, the male attachment means includes a thong having on a first face a plurality of transverse ratchet teeth, the female attachment means comprising a retaining means which is adapted to cooperate with the said ratchet teeth by retracting resiliently so as to allow the ratchet teeth to pass beneath the retaining means when the said thong penetrates into the female attachment means, while it retains at least one of the ratchet teeth when the said thong tends to be retracted or removed from the female attachment means.

Preferably, the female attachment means includes an engagement surface on which a second face of the said thong, opposed to the said first face, slides when the thong advances through the said passage; and the said retaining means is a resilient tongue extending between a junction end and a free end which faces towards the said engagement surface, the said tongue having an inclination such that the length of the resilient tongue from the said junction end to the said free end thereof extends in a direction towards the engagement surface and away from the entry end and towards the exit end, with the said free end resiliently engaging the said first face of the thong when the thong is engaged in the said passage, the ratchet teeth of the thong actuating the free end of the resilient tongue when the thong is displaced into the passage, whereby when the thong penetrates the female attachment means, the free end of the tongue then slides over the ratchet teeth, lifting and then falling as each ratchet tooth passes beneath it, while when the thong tends to be retracted or withdrawn from the female attachment means, the free end of the tongue is caused to fall and blocks the ratchet tooth of the thong which has caused it to fall.

Such a retaining means is particularly reliable as regards resistance to coming apart, because the larger the forces tending to bring about such release, the greater is the extent to which the resilient tongue is urged downwardly into engagement with the ratchet teeth, that is to say to become pressed onto the thong, which is then retained both by the obstruction to movement of the tooth which is provided by the resilient tongue, but also by the gripping effect between the engagement surface and the free end of the resilient tongue.

In order to improve still further the ease with which the male element can be introduced into the female element, and to improve still further the strength of the resistance against retraction of the male element out from the female element:

each ratchet tooth preferably has an inclined surface and a straight surface, the inclined surface meeting the free end of the resilient tongue before the straight surface when the thong is inserted into the female attachment means:

the free end of the resilient tongue preferably includes a tooth having a shape complementary to each one of the ratchet teeth, in such a way that it is adapted to become lodged in a recess between two consecutive ratchet teeth; and the free end of the resilient tongue preferably has two teeth having a shape complementary to the shapes of the ratchet teeth, spaced apart in a similar way to two consecutive ratchet teeth such that the two teeth of the tongue are adapted to become lodged in two consecutive recesses, each of which lies between two consecutive ratchet teeth.

In accordance with further preferred features, the female attachment element includes a wall at the entry end which is at least partially in facing relationship to the resilient tongue, and the resilient tongue includes a safety foot, the free end of which is in facing relationship to the said wall, with which the said free end is adapted to come into abutting relationship, so as to limit the deformation of the resilient tongue when the thong tends to be retracted out from the female attachment means.

These features are good from the reliability point of view because, with the safety foot, the deformation of the resilient tongue, under the effect of a bursting force of particularly high intensity, which would cause its free end of the female attachment means to be deflected towards the entry end to the point where it could allow the teeth of the male attachment means to pass below it, is prevented.

In accordance with preferred features, the said flexible strap is secured to the said male attachment means and to the said female attachment means by moulding of the attachment means onto its first end and its second end respectively.

In this way, the assembly of the strap and the male and female attachment means is achieved in a particularly simple way. In particular, the danger of unfastening which could occur if the strap were secured by means of a knot, which is always liable to come undone, especially in the presence of vibrations such as can be met with for example in a vehicle, is avoided.

In a second aspect, the invention is related to seat covers, and aims to provide such covers with means whereby the covers can be fixed and held in a stretched condition on a seat, without delicate maneuvering and with reliability as regards maintaining the stretched state of the covers.

To this end, the invention provides a seat cover, characterised in that it includes a hem which is peripheral to an opening for introduction of the cover onto the seat, together with a fastening device of the kind discussed above, the strap of which is inserted through the said hem.

The invention further provides, in a third aspect, a method of securing a cover onto a seat, characterised in that a cover is used which is provided with a hem peripheral to an opening of the cover, with the strap of a fastening device of the kind discussed above being inserted through the said hem; in that the cover is slid onto the seat, which is introduced into it through the said opening; and in that the male attachment means is then inserted into the female attachment means so as to tension the cover on the seat.

BRIEF DESCRIPTION OF THE DRAWINGS

The disclosure of the invention will now be continued by the description of one embodiment, given below by way of non-limiting example and with reference to the attached drawings. In the latter.

DETAILED DESCRIPTION OF THE ILLUSTRATED EMBODIMENTS

The annular fastening element 1 comprises a male attachment means 2, a female attachment means 3, and a flexible strap 4, which is secured to one end of the male attachment means 2 and at the other end to the female attachment means 3.

In the example shown, the strap 4 is of polyester fibre, while the male and female attachment means 2 and 3 are of injection moulded polyamide, the strap 4 and the means 2 and 3 being secured together by encapsulation. Other materials can be used for the fastening element, especially nylon fibres for the strap 4 and polyacetyl fibres for the attachment means 2 and 3.

Figure 3:
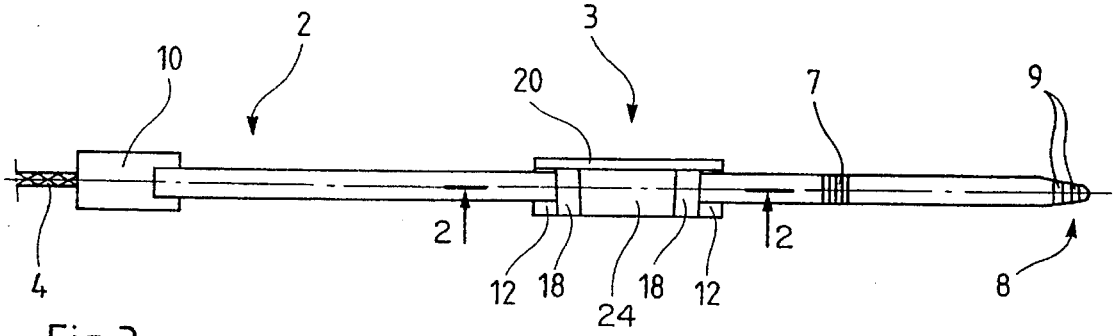
FIG. 3 is a top plan view corresponding to FIG. 2.

The male attachment means 2 includes a thong 5, the lower face 6 of which is smooth, while its upper face has a plurality of transverse teeth 7 which are very close together (and of which only a few have been shown in FIG. 3, so as to keep the drawing simple), which have the shape of a factory roof north light, that is to say an inclined wall on one side and a relatively perpendicular wall on the other side, the inclined wall being situated on the same side as the free end 8 of the thong 5. The free end portion 8 (see FIG. 3) has a triangular shape, with two transverse ridges 9 on its upper face, these being more rounded and wider than the teeth 7. Behind the triangular free end 8, the teeth 7 extend over the major part of the thong 5, with the upper face of the latter becoming smooth prior to its end 39 by which it is attached to a flat wall 10, the lower face of which is joined to the side surface of a cylinder 11, at which one of the ends of the strap 4 is taken into the body of plastic material.

The female attachment means 3 also has a flat wall 12, the lower face of which is joined to the side surface of a cylinder 13 at which the other end of the strap 4 is brought into the mass of plastic material. At some distance above the wall 12, another flat wall 14 is provided parallel to the wall 12, and a resilient tongue 15 is joined to a recessed wall 24 through an attachment end, the free end 16 of the tongue being in facing relationship to the upper face 17 of the wall 12. The walls 12, 14, and 24 are joined together through two walls 18 which are symmetrical and opposed, being in the shape of stairs which are joined on either side of the walls 14 and 24, so that the assembly constituted by the walls 18, 14, and 24 has a shape like that of a podium having three steps, the resilient tongue 15 being movable within such a recess or hollow cavity 25. An aperture 19A is formed above the surface 17 at the foot of the wall 18 which lies on the same side as the attachment end of the resilient tongue 15, while a similar aperture 19B is formed in the opposed wall 18. A rear wall 20 and a front wall 21 are arranged transversely to the walls 12, 14, 18, and 24 respectively, so that each aperture 19A and 19B is bounded by the wall 12, the wall 20, the wall 18 and the wall 21. It will be seen that between the apertures 19A and 19B, a passage is formed for the thong 5, with the aperture 19A defining the entry end and the aperture 19B the exit end.

Figure 1:
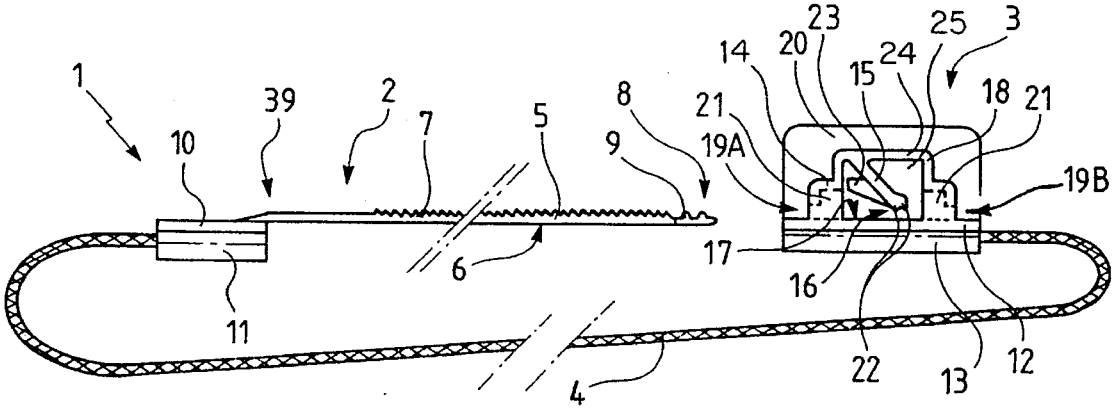
FIG. 1 is a view in elevation showing an annular fastening element constructed in accordance with the invention, in an open position but with the male attachment means ready to be introduced into the female attachment means.
Figure 2:
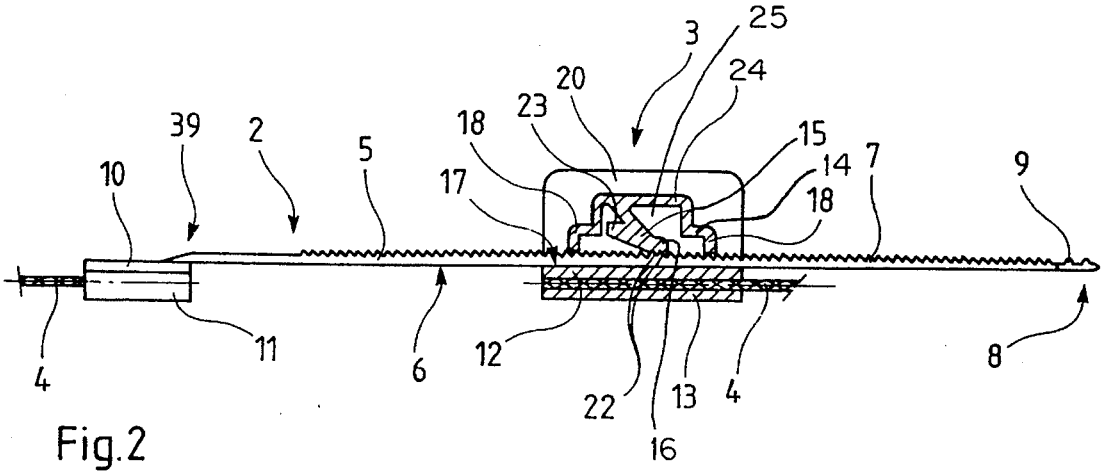
FIG. 2 is a partial cross-sectional view similar to FIG. 1, but with the male attachment means in engagement in the female attachment means, the latter being shown in cross section as indicated at 2—2 in FIG. 3.

In order to close the annular fastening element 1 on itself, it is arranged as shown in FIG. 1; the thong 5 is introduced into the passage of the female attachment means 3 with the free end 8 being inserted first; the lower face 6 of the tongue 5 slides on the upper face 17 of the wall 12 which defines an engagement surface, with the ridges 9 meeting the resilient tongue 15 and pushing on its free end, which slides over the ridges 9 and is raised before falling again when each of the ridges 9 has passed, that is to say the free end 16 is displaced away from the surface 17 and then towards it, with the first teeth 7 meeting the tongue 15 and cooperating with the latter in a similar way; the end 8 leaves the passage in the attachment means 3 through the aperture 19B; and the positioning of the thong 5 is continued until the required fastening tension is achieved, this being obtained for example when the position shown in FIG. 2 has been reached. It will be seen that if the thong 5 then tends to be withdrawn from the passage of the female attachment means 3, the tooth or teeth 7 which are in engagement with the tongue 15 will then urge the free end 16 of the tongue 15 downwards, so that it bears on the thong 5, in such a way that the thong 5 is unable to be retracted; and more generally it will be seen that the male attachment means 1 is unable to be retracted from the female attachment means 3.

It will be noted that this operation is obtained mainly because the resilient tongue 15 has an inclination such that the longitudinal extent of the latter extending from the end thereof which is attached to the wall 24 to its free end 16 extends in a direction towards the surface 17 and away from the entry aperture 19A, which is the same direction as that in which the thong 5 is introduced into the female attachment means, that is to say in the direction from the aperture 19A towards the aperture 19B; and it will also be noted that the thong 5 and the tongue 15 are so dimensioned that the tongue 15 bears resiliently on the teeth 7, and that it is capable of being withdrawn elastically from its engages position so as to allow the teeth to pass when the thong is being inserted into the female element, while the tongue retains the tooth in engagement with it when the thong tends to be withdrawn out from the female attachment element 3.

It will be seen that, when the thong 5 is forced into the female attachment means 3, the inclined surface of each tooth 7 meets the free end 16 of the resilient tongue 15 before its perpendicular surface does.

The free end 16 of the tongue 15 has two teeth 22, which are of complementary shape to the teeth 7 and which are spaced apart in a similar way to two consecutive teeth 7, so that both of the teeth 22 become lodged in two consecutive hollows, each of which is disposed between two consecutive 7 (see FIG. 2). This improves the reliability with which the thong 5 is retained by the tongue 15.

This reliability is improved even more due to the presence of the security foot 23, the free end of which is in facing relationship to a portion of the wall 18 lying on the same side as the aperture 19A: in the event of the deformation of the resilient tongue 15 becoming too large under the effect of a force tending to cause the thong 5 to be withdrawn from the means 3, the free end of the foot 23 will come into abutment on the wall 18 and will prevent such deformation of the tongue 15.

Figure 4:
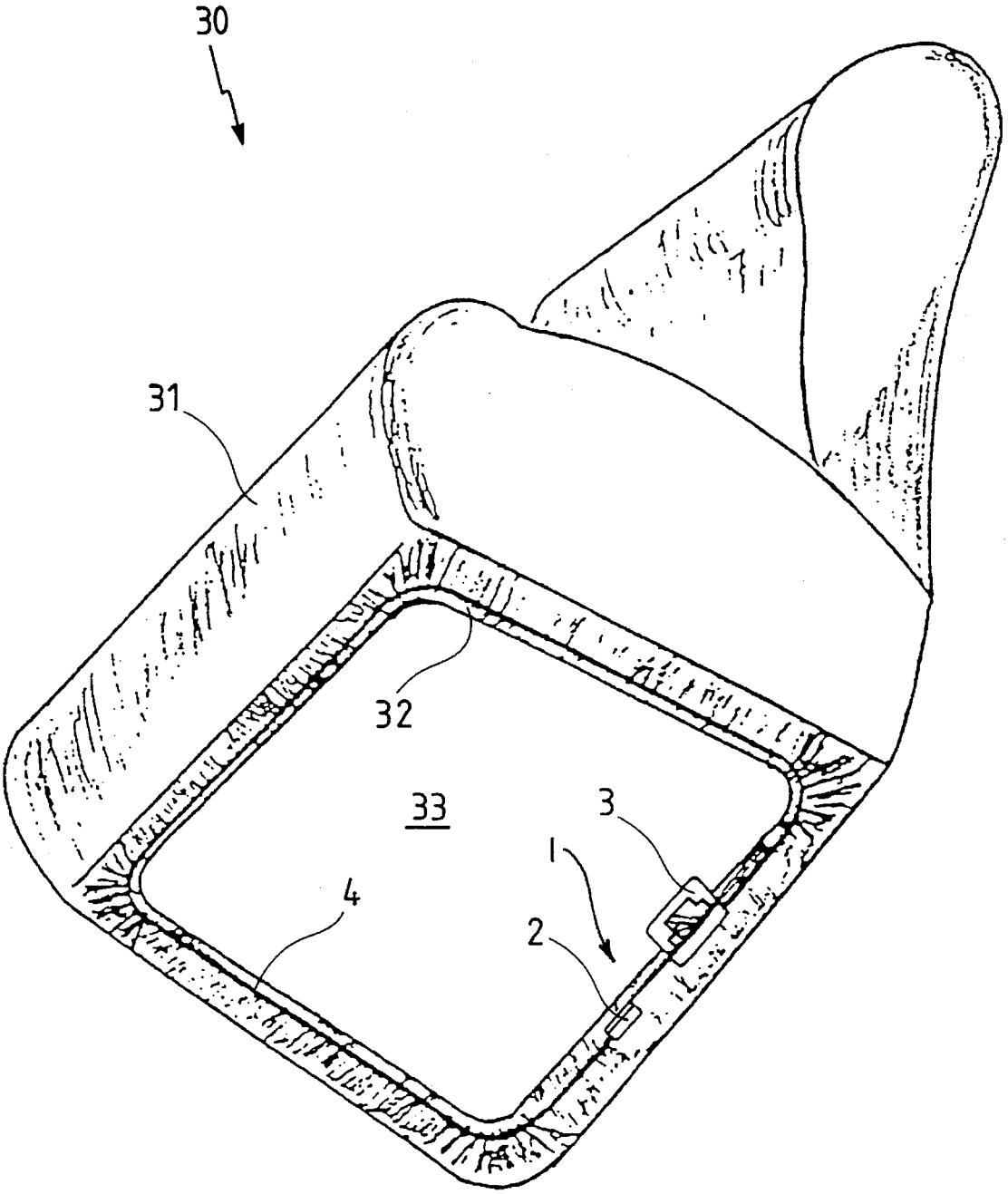
FIG. 4 is a diagrammatic perspective view showing a motor vehicle seat covered with a cover which is fixed and held in a tensioned condition by the annular fastening element shown in FIGS. 1 to 3.

The seat 30 which is shown in FIG. 4 is a motor vehicle seat covered with a seat cover 31 having a peripheral hem 32 around an opening 33 of the seat cover, the hem 32 being interrupted over nearly half the length of the side of the opening 33 lying on the right hand side of FIG. 4, with the strap 4 of the annular fastening element 1 being introduced into the hem 32 and the male and female attachment means 2 and 3 being disposed along the space at which there is no hem, the element 1 having been tightened to the position shown, in which the seat cover 31 is held on the seat in a tentioned condition.

It can be seen that due to the male attachment means 2, it is particularly easy to close the annular fastening element of the seat cover 31 on itself and to adjust this element so as to stretch the seat cover, and that in addition, the tension in the seat cover will be maintained with great reliability in spite of the heavy dynamic forces to which such a seat cover can be subjected.

The fastening of the seat cover 31 is carried out by sliding it onto the seat 30, which is introduced into it through the opening 33, and then when the cover has been positioned, the whole structure of the base of the seat (which is made of foam in the example shown) is slightly compressed; and it is at this instant that the element 1 is tightened to the desired tension, with the hem then being situated under the base of the seat 30.

The seat cover 31 covers both the squab and the base of the seat 30, though in a modification the seat cover may cover only the base of the seat. In that case, if the seat does have a squab, the latter may be covered by a further seat cover which may be secured in a different way.

The invention is of course not limited to the examples described and shown. Obviously, many changes and modifications of the present invention are possible in light of the above teachings. It is therefore to be understood that within the scope of the appended claims, the present invention may be practiced otherwise than as specifically described herein.

I claim:

1. An annular fastening device, comprising:

a male attachment means (2) fabricated from a moulded plastic material;

a female attachment means (3) fabricated from a moulded plastic material and defining, between an entry end (19A) and an exit end (19B), a passage for accommodating said male attachment means (2);

said male and female attachment means (2, 3) being respectively provided with first and second engagement means (7, 15) which are adapted to cooperate in such a manner that said male attachment means (2) can be inserted into said female attachment means (3) by advancing through said passage in a direction extending from said entry end (19A) to said exit end (19B) whereby once said male attachment means (2) has been inserted a predetermined extent into said female attachment means (3), if said male attachment means (2) is attempted to be retracted out from said female attachment means (3), said male attachment means (2) is retained within said female attachment means (3) at the position to which it has been inserted; and a flexible strap (4), fixed at a first end to said male attachment means (2), and at a second end to said female attachment means (3) such that said second end of said flexible strap (4) extends away from said exit end (19B) of said female attachment means (3) in a direction which is substantially parallel to said passage of said female attachment means (3) and said direction defined by said passage through which said male attachment means (2) advances when said male attachment means (2) is inserted into said passage of said female attachment means (3);

said female attachment means (3) comprising a base wall (12) for supporting said male attachment means (2) as said male attachment means (2) is inserted into said female attachment means (3); an upper wall (14) spaced above said base wall (12) and disposed parallel thereto; and a hollow recessed cavity (25) defined within said upper wall (14); said second engagement means (15) of said female attachment means (3) being integrally connected to a recessed upper wall (24) of said hollow recessed cavity (25) at a first end, of said second engagement means (15), which is disposed opposite a second end, of said second engagement means (15), which is operatively engaged with said first engagement means (7) of said male attachment means (2); and said hollow recessed cavity (25) comprising end wall means (18) for cooperating with a portion of said second engagement means (15) intermediate said first and second ends of said second engagement means (15) for preventing deformation of said second engagement means (15) beyond a predetermined extent when said male attachment means (2) is attempted to be withdrawn from said female attachment means (3) such that said second engagement means (15) of said female attachment means (3) remains engaged with said first engagement means (7) of said male attachment means (2) so as to prevent said withdrawal of said male attachment means (2) out from said female attachment means (3).

2. A device according to claim 1, wherein:

said male attachment means (2) comprises a thong (5) having on a first face thereof a plurality of transverse ratchet teeth comprising said first engagement means (7); and said female attachment means (3) comprises said second engagement means (15) which is adapted to cooperate with said ratchet teeth (7) by resiliently retracting so as to allow said teeth (7) to pass when said thong (5) is inserted into said female attachment means (3), while said second engagement means (15) retains said ratchet teeth (7) when said thong (5) is attempted to be withdrawn out from said female attachment means (3).

3. A device according to claim 2, wherein:

said female attachment means (3) comprises an engagement surface (17) upon which a second face (6) of said thong (5) slides when said thong (5) advances through said passage; and said second engagement means (15) is a resilient tongue extending between said first end and said second end (16) which faces toward said engagement surface (17), said tongue (15) having an inclination such that the longitudinal extent of said resilient tongue (15) from said first end to said second end thereof extends in a direction toward said engagement surface (17) and away from said entry end (19A) and toward said exit end (19B), with said second end (16) resiliently engaging said first face of said thong (5) when said thong (5) is disposed within said passage, said ratchet teeth (7) actuating said second end (16) of said resilient tongue (15) when said thong (5) is displaced within said passage whereby when said thong (5) is inserted into said female attachment means (3), said second end (16) slides over said ratchet teeth (7), lifting and falling as each ratchet tooth passes, while when said thong (5) tends to be withdrawn out from said female attachment means (3), said second end (16) of said tongue (15) is caused to fall and prevents the ratchet tooth of said thong (5), which caused said second end (16) of said tongue (15) to fall, from moving in the withdrawal direction.

4. A device according to claim 3, characterised in that each said ratchet tooth (7) has an inclined surface and a straight surface, the inclined surface meeting the second end (16) of the resilient tongue (15) before the straight surface when the thong is inserted into the female attachment means (3).

5. A device according to claim 3, characterised in that the second end (16) of the resilient tongue (15) includes a tooth (22) having a shape complementary to the said ratchet teeth (7), in such a way that it is adapted to become lodged in a recess between two consecutive ratchet teeth (7).

6. A device according to claim 5, characterised in that the second end of the resilient tongue has two teeth (22) having a shape complementary to that of said ratchet teeth (7), spaced apart in a way similar to two consecutive ratchet teeth in such a way that the two teeth of the tongue are adapted to become lodged in two consecutive recesses, each of which lies between two consecutive ratchet teeth (7).

7. A device according to claim 3, wherein:

said cooperating means of said female attachment means (3) comprises said end wall means (18) which is at least partially in facing relationship to said resilient tongue engagement means (15) on the same side as said entry end (19A); and said intermediate portion of said resilient tongue (15) comprises a safety foot (23), the free end of which is in facing relationship toward said end wall means (18) with which said free end is adapted to come into abutting relationship so as to limit said deformation of said resilient tongue (15) when said thong (5) is attempted to be withdrawn out from said female attachment means (3).

8. A device according to claim 3, wherein:

said base wall (12) of said female attachment means (3) includes a first side thereof which defines said engagement surface (17).

9. A device according to claim 8, wherein:

said second end of said strap (4) is fixedly retained within a mass of plastic material molded upon a second side of said base wall (12).

10. A fastening device as set forth in claim 3, wherein:

said tongue is pivotally secured at said first end thereof to said upper wall of said hollow cavity (25) so as to resiliently engage said ratchet teeth (7) of said male attachment means (2).

11. A device according to claim 1, characterised in that said flexible strap (4) is secured to said male attachment means (2) and to said female attachment means (3) by moulding of said male attachment means (2) and said female attachment means (3) onto its first end and its second end respectively.

12. A fastening device as set forth in claim 1, wherein said female attachment means (3) further comprises:

a pair of end walls (18) interconnecting said base wall (12) and said upper wall (14), and having entrance and exit apertures defined therewithing so as to define said entry end (19A) and said exit end (19B) within said female attachment means (3); and a pair of side walls (20, 21) for cooperating with said base wall (12), said upper wall (14), and said pair of end walls (18) for defining said hollow cavity (25) of said female attachment means (3).

13. A fastening device as set forth in claim 1, wherein:

said male and female attachment means (2, 3) comprise injection moulded polyamide; and said flexible strap (4) comprises polyester fiber.

14. A fastening device as set forth in claim 1, wherein:

said male and female attachment means (2, 3) comprise polyacetyl fibers; and said flexible strap (4) comprises nylon fibers.

15. An annular fastening device, comprising:

a male attachment means (2) fabricated from a molded plastic material;

a female attachment means (3) fabricated from a molded plastic material and defining, between an entry end (19A) and an exit end (19B), a passage for accommodating said male attachment means (2);

said male and female attachment means (2, 3) being respectively provided with first and second engagement means (7, 15) which are adapted to cooperate in such a manner that said male attachment means (2) can be inserted into said female attachment means (3) by advancing through said passage in a direction extending from said entry end (19A) to said exit end (19B) whereby once said male attachment means (2) has been inserted a predetermined extent into said female attachment means (3), if said male attachment means (2) is attempted to be withdrawn from said female attachment means (3), said male attachment means (2) is retained within said female attachment means (3) at the position to which it has been inserted; and a flexible strap (4), fixed at a first end to said male attachment means (2), and at a second end to said female attachment means (3);

said female attachment means (3) comprising a base wall (12) for supporting said male attachment means (2) as said male attachment means (2) is inserted into said female attachment means (3); an upper wall (14) spaced above said base wall (12) and disposed parallel thereto; and a hollow recessed cavity (25) defined within said upper wall (14); said second engagement means (15) of said female attachment means (3) being integrally connected to a recessed upper wall (24) of said hollow recessed cavity (25) at a first end, of said second engagement means (15), which is disposed opposite a second end, of said second engagement means (15), which is operatively engage with said first engagement means (7) of said male attachment means (2); and said hollow recessed cavity (25) comprising end wall means (18) for cooperating with a portion of said second engagement means (15) intermediate said first and second ends of said second engagement means (15) for preventing deformation of said second engagement means (15) beyond a predetermined extent when said male attachment means (2) is attempted to be withdrawn from said female attachment means (3) such that said second engagement means (15) of said female attachment means (3) remains engaged with said first engagement means (7) of said male attachment means (2) so as to prevent said withdrawal of said male attachment means (2) out from said female attachment means (3).

16. The fastening device as set forth in claim 15, wherein:

said male attachment means (2) comprises a thong (5) having a plurality of transverse ratchet teeth disposed upon a first surface thereof and comprising said first engagement means (7); and said second engagement means (15) of said female attachment means (3) comprises a resilient tongue having at least one ratchet tooth (22) provided thereon and having a configuration which is complementary to said ratchet teeth of said thong (5) so as to define a ratcheting engagement means with said thong (5) when said thong (5) of said male attachment means (2) is inserted into said passage of said female attachment means (3).

17. The fastening device as set forth in claim 16, wherein:

said base wall (12) of said female attachment means comprises a support surface (17) upon which a second surface of said thong (5) is slidably supported when said male attachment means (2) is inserted into said passage of said female attachment means (3).

18. The fastening device as set forth in claim 15, wherein:

said flexible strap (4) is secured to said male attachment means (2) and said female attachment means (3) by molding said male attachment means (2) and said female attachment means (3) onto first and second end portions, respectively, of said flexible strap (4).

19. The fastening device as set forth in claim 15, wherein:

said male and female attachment means (2, 3) comprise injection molded polyamide; and said flexible strap (4) comprises polyester fiber.

20. The fastening device as set forth in claim 15, wherein:

said male and female attachment means (2, 3) comprise polyacetyl fibers; and said flexible strap (4) comprises nylon fibers.

* * * * *